United States Patent [19]

Zangrando

[11] 4,440,063

[45] Apr. 3, 1984

[54] GUN OPERATED ELECTRICAL FIRING DEVICE

[75] Inventor: Roy A. Zangrando, Boonton, N.J.

[73] Assignee: The United States of America as represented by the Secretary of the Army, Washington, D.C.

[21] Appl. No.: 339,244

[22] Filed: Jan. 13, 1982

[51] Int. Cl.[3] ..... F41D 11/04

[52] U.S. Cl. ..... 89/135

[58] Field of Search ..... 89/28 R, 28 C, 135; 42/84; 102/209

[56] References Cited

U.S. PATENT DOCUMENTS

| | | | |
|---|---|---|---|
| 2,720,819 | 10/1955 | Ryan et al. | 42/84 |
| 2,957,391 | 10/1960 | Lovercheck | 89/135 |
| 3,393,640 | 7/1968 | Harnau | 102/209 |
| 3,981,245 | 9/1976 | Buzzell et al. | 102/209 |

FOREIGN PATENT DOCUMENTS

| | | | |
|---|---|---|---|
| 560813 | 4/1944 | United Kingdom | 89/135 |

*Primary Examiner*—Stephen C. Bentley

*Attorney, Agent, or Firm*—Robert P. Gibson; Anthony T. Lane; A. Victor Erkkila

[57] ABSTRACT

There is disclosed a gun operated firing device which utilizes the kinetic energy of a gas-operated gun to generate, store and discharge voltage to fire electrically primed ammunition. The firing device contains a magnetic circuit comprised of a coil, a capacitor across the output of the coil, a diode between said capacitor and coil, a resistor in parallel with the capacitor and a switch in the form of a firing pin which connects the circuit to the primer. The circuit is in the bolt carrier of the gun which slides on an upper receiver tube containing a magnet causing the flux created to link with the coil.

6 Claims, 9 Drawing Figures

GUN OPERATED ELECTRICAL FIRING DEVICE

GOVERNMENT RIGHTS

The invention described herein may be manufactured, used and licensed by the Government for Governmental purposes without the payment to me of any royalties thereon.

BACKGROUND OF THE INVENTION

The twenty millimeter ammunition currently made by all United States military services is primed by electricity and is employed in aircraft or other vehicle mounted guns where the vehicle's electric power is available to initiate the primer. In situations where infantry type weapons, particularly machine guns, are used but no such electric power source is available, limited-life power sources, e.g. batteries, can be used. These sources of power, because of their bulkiness and limited life, are not suitable for infantry use. This situation is undesirable and uneconomical from a military viewpoint because it otherwise necessitates the manufacture and use of the various types of ammunition of the same caliber employing percussion primers. The more widely used type of twenty millimeter ammunition is that which is electrically primed. There is a need, therefore, for an infantry type weapon, e.g. machine gun of the gas operated type, which has a compact, self-contained, low maintenance gun operated firing device for generating power to fire electrically primed ammunnition, which can be standardized and used in other applications.

BRIEF SUMMARY OF THE INVENTION

This invention relates to a gun operated firing device suitable for use with gas operated guns. The firing device utilizes the kinetic energy of the gas operated gun to generate, store and discharge voltage to fire electrically primed ammunition. The device is comprised of a permanent magnet fixed on a stationary part of the gun, with a coil and capacitor storage circuit mounted on the operating part of the gun and connected to an insulated firing pin. The operating part of the gun oscillates back and forth, causing the coil to pass adjacent to the magnet whereupon the magnetic flux change generates a voltage pulse which is stored in the capacitor and subsequently discharges into the electric primer upon contact of the primer with an insulated firing pin. In other words, voltage is induced in a coil as it passes adjacent to a permanent magnet and is stored in a capacitor which subsequently discharges the voltage through an insulated firing pin to initiate the primer. The firing device is a simple, reliable low cost design.

An object of this invention is to provide a gun operated firing device which generates power from the kinetic energy of the gun to fire electrically primed ammunition.

DETAILED DESCRIPTION OF THE INVENTION

The present invention provides a gun operated firing device which generates electrical power to fire electrically primed ammunition.

Figure 1:
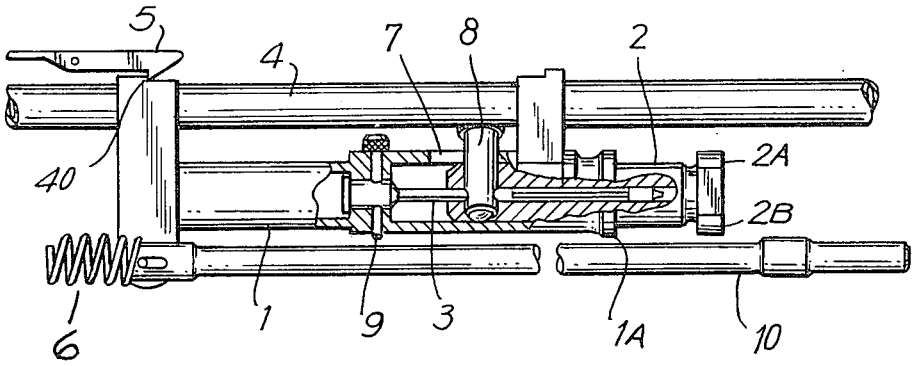
FIG. 1 is a side elevational view in longitudinal section of a gas operated prior art gun illustrating the bolt carrier portion which is modified in this invention.

Referring to the drawings, FIG. 1 depicts a portion of a gas operated machine gun such as that described in U.S. Pat. No. 4,311,082, issued on Jan. 19, 1982 to Curtis D. Johnson and Philip L. Baker, wherein a bolt carrier 1 comprised of a bolt 2 and a firing pin 3 is in sliding relationship with an upper receiver tube 4. In order to prepare the gun for initial firing, the user cocks the bolt carrier 1 toward the rear of the gun against a spring 6 where the bolt carrier 1 is retained by a sear 5 which engages a raised portion 40 on the bolt carrier 1. Manual release of the sear 5 causes the bolt carrier 1 to move under bias of the spring 6 forward along the upper receiver tube 4 in a firing stroke. As the bolt carrier 1 continues to move, a cam pin 8 in the bolt 2 rides in helical slot 7 in the bolt carrier 1, thereby turning the bolt 2 so that lugs 2A, 2B are rotated in locked position inside a gun barrel (not shown). A notch (not shown) in the upper receiver tube 4 allows the cam pin 8 and the bolt 2 to rotate during interaction with the helical slot. The motion of the bolt carrier 1 is stopped when the forward shoulder 1A contacts the barrel, allowing the firing pin 3 which is fixed to the bolt carrier 1 by a retaining pin 9 to extend from the bolt 2 and thus impact the primer of the chambered round, causing the round to be fired. Upon firing, the pressure of the resulting propelling gas acts on an operating rod 10 to return the bolt carrier 1 against the bias spring 6 to repeat the cycle or be retained by the sear 5.

In order to modify the above described presently used gas operated gun in accordance with this invention to generate, store and discharge voltage, a permanent magnet must be fixed on a stationary part of the gun, and a coil and capacitor storage circuit must be mounted on the operating part of the gun and connected to an insulated firing pin.

Figure 2:
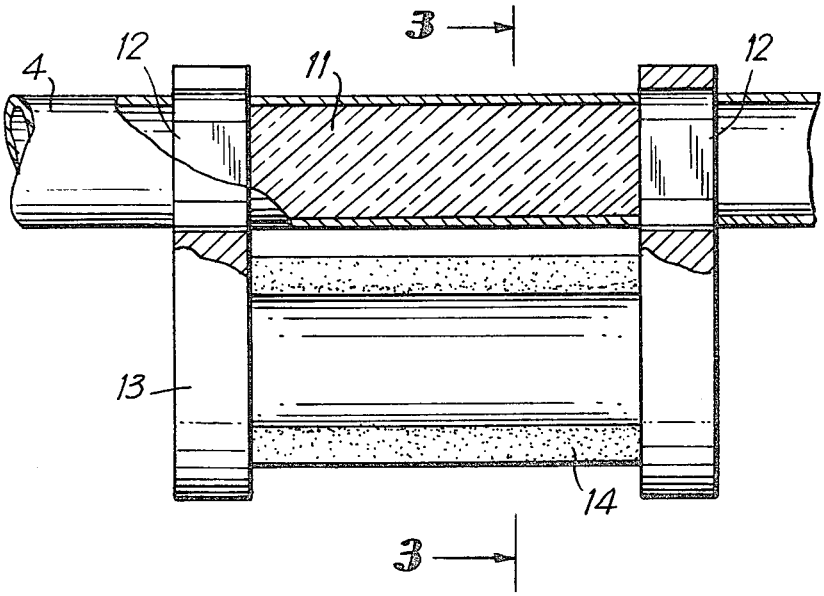
FIG. 2 is a side sectional view of the magnetic elements of this invention.
Figure 3:
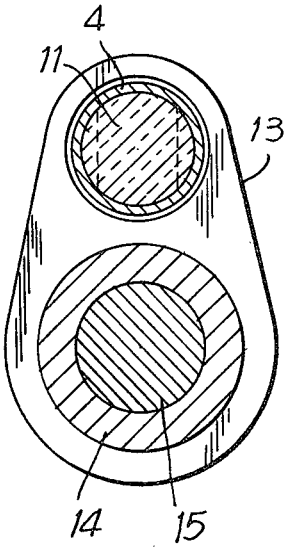
FIG. 3 is a view of the magnetic elements of this invention along line 3—3 of FIG. 2.

Specifically, the device of FIG. 1 is modified by providing nonmagnetic receiver tube 4 with a magnet 11 in a portion of its length as shown in FIGS. 2 and 3. The magnet 11 is provided with soft iron poles 12 at each end. The magnetic poles 12 extend through to the outer surface of the receiver tube 4. The flux of the magnet 11 is linked with a coil of insulated wire 1 in a magnetically permeable yoke 13 which is in sliding relationship with receiver tube 4. In operation, the yoke 13, initially displaced from the magnet 11, is moved rapidly into alignment with the latter, thus inducing a voltage pulse in the coil 14 by virtue of the flux change. The pulse has a magnitude proportional to the rate of the flux change.

Figure 4:
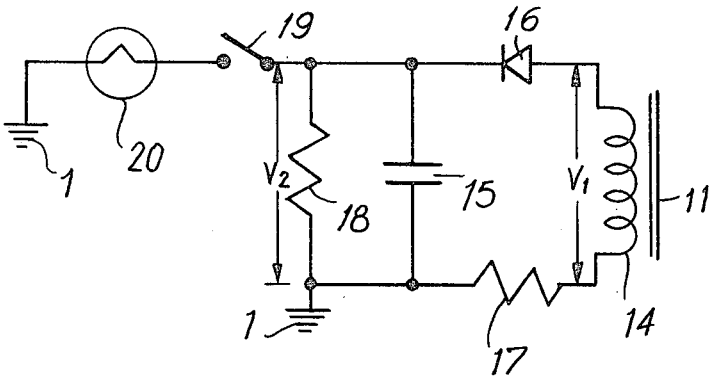
FIG. 4 is a schematic diagram of the electric circuitry of this invention.

FIG. 4 illustrates the electric circuit of the structure of this invention. The circuit is comprised of the magnet 11, a coil 14, a capacitor 15 across the output of the coil 14, a diode 16 between the capacitor 15 and the coil 14, a resistor 17 representing the resistance of the windings of the coil 14 and a bleed resistor 18 in parallel with the capacitor 15. A switch 19 representing the insulated firing pin connects the circuit to the primer 20.

Figure 5:
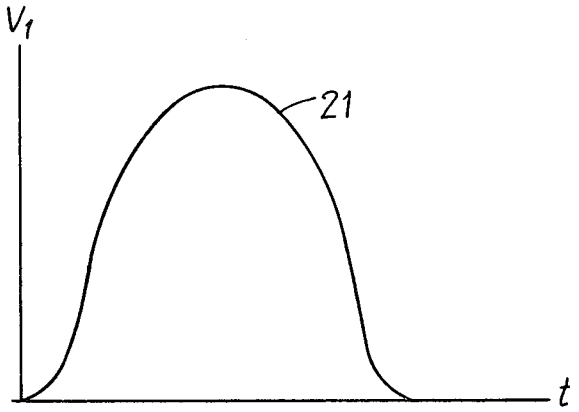
FIG. 5 is a graph of the relationship of the voltage output of the coil and time during the firing stroke, using this invention.
Figure 6:
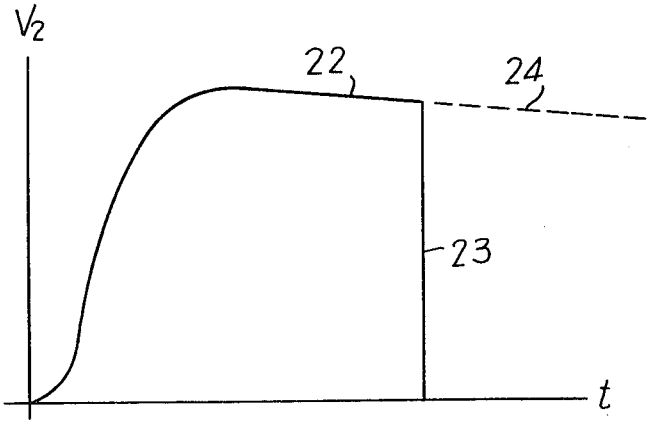
FIG. 6 is a graph of the relationship of the voltage output of the circuit and time during initiation of the primer, using this invention.
Figure 7:
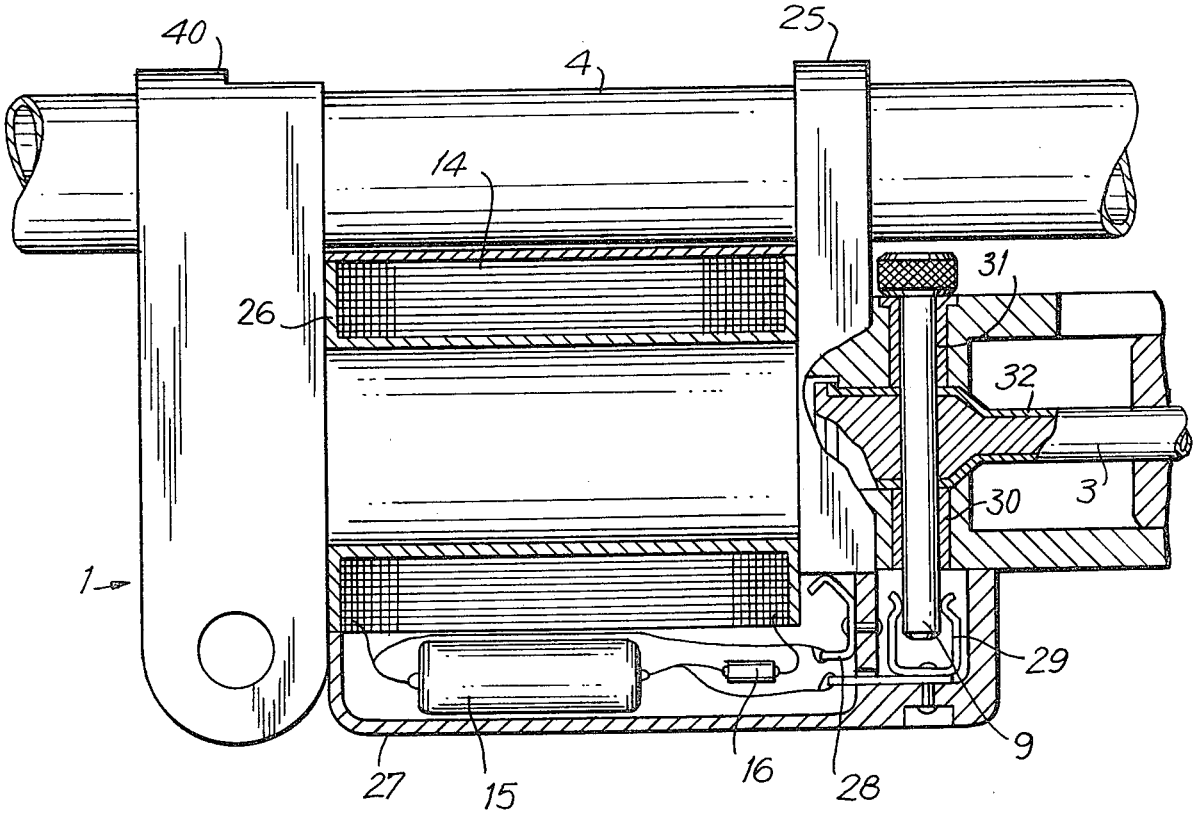
FIG. 7 is a side elevational view, partially in section illustrating the bolt carrier of a gas operated gun with the firing device of this invention incorporated therein.

In operation, a positive voltage pulse 21, as shown in FIG. 5, induced in the coil 14 during the firing stroke, charges the capacitor 15, through the diode 16. Upon closing the switch 19, as shown in FIG. 6, the stored voltage, line 22 on the graph, discharges, line 23 on the graph, to initiate the primer 20. If the discharge 23 does not occur (i.e. through the primer 20), the bleed resistor 18 slowly discharges, line 24 on the graph, the capacitor. When the bolt carrier 1 returns after firing and the yoke 13 moves away from the magnet 11, another voltage pulse is induced similar to that during the firing stroke, shown by line 21 in FIG. 5, but negative in value. The diode 16 isolates the negative voltage pulse from the rest of the circuit.

The firing device of this invention can be incorporated into the structure of a gun such as the one depicted in section in FIG. 1, as shown in the preferred embodiment in FIGS. 2–7. The bolt carrier 1 is modified by the addition of a leg 25 which completes the magnetic circuit described above. The modified bolt carrier 1 serves as a magnetically permeable yoke 13 which is free to slide on the upper receiver tube 4 and which yoke 13 contains a coil of insulated wire 14 wound on a bobbin 26 mounted on the yoke 13, thus completing the magnetic circuit by linking the flux of the magnet 11 with the coil 14. The electrical circuit elements are contained in a compartment 27 which is adjacent to the coil 14. The circuit is grounded to the bolt carrier 1 by a spring clip 28. The positive connection to the retaining pin 9 is made by a spring clip 29. The retaining pin 9 is electrically isolated from the bolt carrier 1 by the insulators 30 and 31 which are between the retaining pin 9 and the bolt carrier 1. The retaining pin 9 passes through the firing pin 3 in electrical contact therewith. The firing pin 3 is electrically isolated from the other gun parts by an insulated coating 32. In operation, the firing pin 3 contacts the primer 20 and discharges the capacitor 15 through the primer 20, thus serving the function of the switch 19 shown in FIG. 4.

Figure 8:
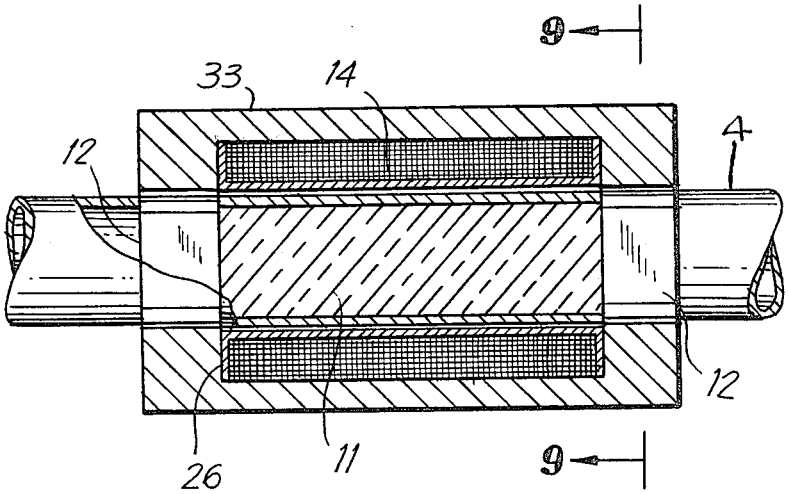
FIG. 8 is a side elevational sectional view of an alternative embodiment of the magnetic elements of this invention.
Figure 9:
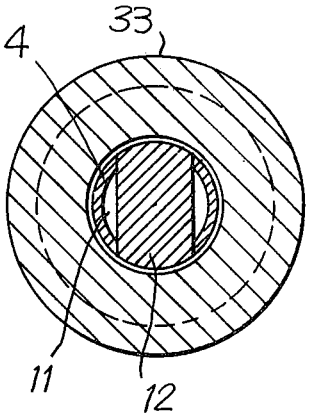
FIG. 9 is a view taken along line 9—9 of FIG. 8.

FIGS. 8 and 9 depict an alternative embodiment which differs from the preferred embodiment by comprising a coil 14 placed around the upper receiver tube 4 which is enclosed by a cylindrical yoke 33 concentric to the receiver tube 4. The remaining structures are as in the preferred embodiment.

This invention has been described with respect to certain embodiments and modifications. Variations in the light thereof will be suggested to persons skilled in the art and are to be included within the spirit and purview of this application and the scope of the appended claims.

I claim:

1. A gun operated firing device which generates power to fire electrically primed ammunition in a gas-operated gun having a sliding bolt carrier comprised of a bolt, a firing pin and a retaining pin to fix the firing pin to the bolt carrier, wherein said bolt carrier slides on a receiver tube; comprising an electric circuit, which includes a magnet fixed in said receiver tube wherein said receiver tube is non-magnetic, and a magnetically permeable yoke affixed to said bolt carrier in freely sliding relationship with said non-magnetic receiver tube; a coil of insulated electric wire mounted in said yoke exterior to said receiver tube, a capacitor across the output of said coil; a diode between the capacitor and the coil; and a primer, wherein said firing pin connects said circuit to said primer and is electrically insulated from said bolt carrier, and wherein said yoke is initially displaced from said magnet and is moved into alignment with said magnet upon forward movement of said bolt carrier, thereby inducing a voltage pulse in said coil by a flux change, said voltage pulse charging the capacitor with a charge sufficient to initiate said primer when said firing pin contacts said primer.

2. The firing device of claim 1, wherein said coil is around the receiver tube and is enclosed by a cylindrical yoke concentric to said receiver tube.

3. The firing device of claim 1, wherein said magnet comprises soft iron poles at each end extending through to the outer surface of said receiver tube.

4. The firing device of claim 1, wherein said circuit includes a bleed resistor in parallel with said capacitor.

5. The firing device of claim 1, wherein the coil is disposed laterally of said receiver tube.

6. The firing device of claim 1, wherein both the coil and capacitor are mounted in said yoke.

* * * * *